United States Patent [19]

Vratny

[11] 4,154,877

[45] May 15, 1979

[54] ELECTROLESS DEPOSITION OF GOLD

[75] Inventor: Frederick Vratny, Berkeley Heights, N.J.

[73] Assignee: Bell Telephone Laboratories, Incorporated, Murray Hill, N.J.

[21] Appl. No.: 896,345

[22] Filed: Apr. 14, 1978

Related U.S. Application Data

[62] Division of Ser. No. 754,124, Dec. 27, 1976, Pat. No. 4,122,215.

[51] Int. Cl.[2] ..... C23C 3/02

[52] U.S. Cl. ..... 427/328; 106/1.26; 156/664; 252/79.3; 252/79.4; 427/304; 427/307; 427/430 A; 427/437

[58] Field of Search ..... 427/304, 307, 328, 437, 427/430 A; 106/1.23, 1.26; 252/79.3, 79.4; 156/664

[56] References Cited

U.S. PATENT DOCUMENTS

| | | | |
|---|---|---|---|
| 2,976,181 | 3/1961 | Brookshire | 106/1.26 |
| 3,123,484 | 3/1964 | Pokrus et al. | 106/1.26 |
| 3,468,676 | 9/1969 | Schneble et al. | 427/437 |
| 3,642,549 | 2/1972 | Couture et al. | 252/79.3 |
| 4,040,897 | 8/1977 | Blish et al. | 252/79.3 |
| 4,082,908 | 4/1978 | Vanaglash | 427/437 |

OTHER PUBLICATIONS

Reid et al., Gold Plating Technology, Electrochemical Publications Limited, 1974.

*Primary Examiner*—John D. Smith
*Attorney, Agent, or Firm*—Michael J. Urbano

[57] ABSTRACT

A method for depositing electroless nickel on aluminum or aluminum alloy is described. The method is particularly useful for fabricating bonding pads on aluminum metallized semiconductor devices and for creating beam leads. The described method deposits a thick nickel layer directly on aluminum without the use of intermediate layers or surface activation as required in the prior art. The method basically comprises immersion in a stop-etchant which simultaneously removes aluminum oxide and activates the surface; immersion in a solution which activates the aluminum with nickel ions and deactivates mask material; and immersion in a novel electroless nickel bath. A technique for electrolessly depositing gold is also described.

5 Claims, 7 Drawing Figures

ELECTROLESS DEPOSITION OF GOLD

This application is a Divisional of copending application Ser. No. 754,124 filed on Dec. 27, 1976 now U.S. Pat. No. 4,122,215.

BACKGROUND OF THE INVENTION

1. Field of the Invention

The invention relates to electroless deposition of metals. More particularly, it relates to the selective deposition of nickel on aluminum metallized semiconductor devices in predetermined areas defined by openings in a suitable dielectric or photoresist. Electroless deposition of gold is also described.

2. Description of the Prior Art

Aluminum is one of the preferred metals for semiconductor active device contacts for various reasons such as ease of evaporation, good electrical conductivity, and lack of adverse side effects on the electrical characteristics of the devices. However, the use of aluminum has two major problems: (1) it is not directly solderable and (2) it rapidly forms an impervious oxide. It is, thus, difficult to bond wire leads to the aluminum contact. One solution is direct thermocompression bonding of gold to aluminum. However, the composite degrades into a brittle intermetallic which degrades the contact. Another current technique is multimetallization as used for beam lead fabrication. This is a complex and costly procedure involving multiple photolithography steps to apply Ti/Pd/Au or Ti/Pt/Au metallization.

Nickel is an inexpensive, solderable material which can be used on top of aluminum metallization to enable contact of leads to the aluminum. Nickel also has the advantages of being harder than aluminum and more corrosion resistant. However, the formation of aluminum oxide has made it difficult to deposit nickel directly on aluminum without extensive pretreatment. A common pretreatment technique is zincating, the deposition of an intermediate zinc film which replaces the aluminum/aluminum oxide. Another example is ion activation, the activation of the surface with tin or palladium ions. Fluoride ions have also been used for activation but in large concentrations will etch into the aluminum. Ion activation and zincating overactivate and can cause deposition of nickel in areas other than where desired e.g., on a dielectric mask. The metals deposited during pretreatment also diffuse into the aluminum. Zinc diffusion, for example, reduces device lifetime by causing the aluminum to become brittle and, in the case of silicon, by altering the doping level.

SUMMARY OF THE INVENTION

The inventive method permits electroless deposition of nickel directly on aluminum or its alloys without the extensive pretreatment prevalent in the prior art and its consequent deleterious effects. The method is particularly useful for selective deposition of nickel in predetermined areas defined by apertures in a dielectric or photoresist. The pretreatment involves removal of aluminum oxide and activation of the surface with a subsequent step for deactivation of the mask relative to the aluminum. The electroless plating bath deposits nickel on the desired areas.

One aspect of this method is a pretreatment in which the substrate is immersed in a stop-etchant comprising buffered hydrofluoric acid and a nonaqueous solvent; and is then immersed in a solution of a soluble nickel salt. Another aspect is the subsequent immersion of the substrate in an electroless nickel hypophosphite-based plating bath which contains various stabilizers (e.g., formaldehyde), wetting agents (e.g., p-toluene sulfonic acid), buffers (e.g., sodium acetate), and buffered hydrofluoric acid to yield a good deposit and increase bath controllability.

This method has been used to apply thick nickel bonding pads on aluminized integrated circuits. The bonding pads hermetically seal the contact, thus, reducing environmental contamination of the device. The pad can be easily soldered to the lead wire or can be electrolessly plated with gold or copper for subsequent ball bonding or compliant applique bonding. Other applications include beam leading and plating of laser heat sinks and aluminum stud mounts. The method is economical for its simplicity and reliability. Bonding pads fabricated according to this invention have good mechanical strength and extended lifetimes.

Another aspect of the invention is an electroless gold plating technique which is suitable for depositing gold on the electroless nickel or other metals. The electroless gold plating bath is hypophosphite-based and is maintained at about neutrality by a suitable buffer (e.g., sodium bicarbonate).

The invention, as well as its advantages, will be better understood by reference to the following detailed description of illustrative embodiments read in conjunction with the accompanying drawing.

DETAILED DESCRIPTION

General Technique

Figure 1:
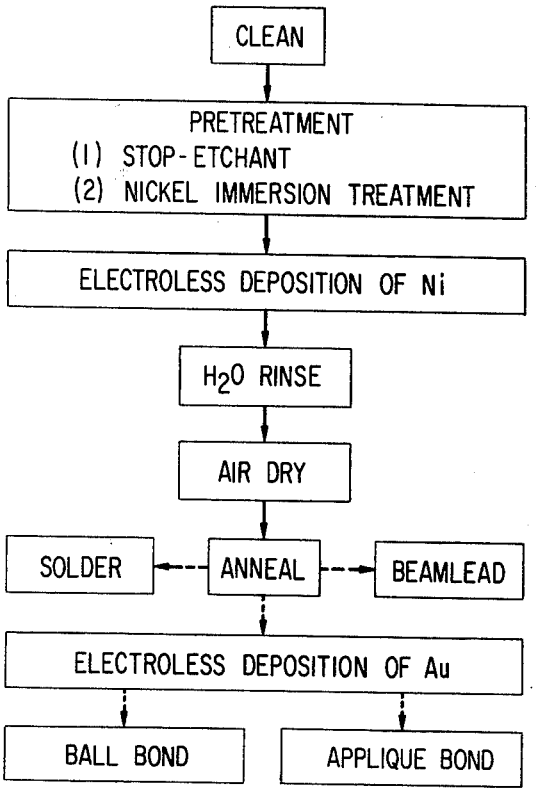
FIG. 1 is a flow diagram indicating the method steps for electroless deposition of nickel on aluminum.

FIG. 1 shows the method steps in an illustrative embodiment of the electroless deposition of nickel on aluminum. The pretreatment encompasses two distinct steps which permit electroless deposition without deleterious side effects and confines deposition to the desired area if the substrate is masked. The first step in the pretreatment removes the aluminum oxide and simultaneously activates the entire surface. The second step activates the aluminum with nickel ions and, if patterned with a mask, deactivates the mask relative to the aluminum. A typical pretreatment for an aluminum metallized integrated circuit wafer having a silicon nitride mask is as follows:

| PRETREATMENT | |
|---|---|
| STOP-ETCHANT | |
| Buffered hydrofluoric acid | :ethylene glycol,<br>:amyl acetate,<br>:ethyl acetate,<br>:ether, |

-continued

| PRETREATMENT | | |
|---|---|---|
| | :ethyl cellusolve, | |
| Room Temperature, 18° C. | | |
| 0.25–3 min (depending on concentration) | | |
| Vol. ratio 1:2 to 4:1 | | |
| NICKEL IMMERSION | | |
| | Per liter $H_2O$ | |
| Nickel sulfate, -chloride, -acetate | 1.1–50 g | 0.07–0.3M |
| Ammonium chloride, -citrate, -acetate | 3–40 g | 0.05–0.75M |
| p-Toluene sulfonic acid | 0.01–0.5 g | |
| Buffered hydrofluoric acid | 0.01–10 ml | |
| Room Temperature, 18° C. | | |
| 15–60 sec | | |

Following standard cleaning procedures, the substrate is first immersed in a buffered hydrofluoric acid stop-etchant. Buffered hydrofluoric acid, BOE (Buffered Oxide Etchant), is a 6.7:1 (Vol.) mixture of 40% ammonium fluoride and 49% hydrofluoric acid. BOE when mixed with a nonaqueous solvent such as ethylene glycol, amyl acetate, ethyl acetate, ether, or ethyl cellusolve acts as a stop-etchant since it dissolves the oxide at a much faster rate than the aluminum. Fluoride ions activate the substrate surface. Variation of the ratio of BOE to solvent (preferably between 1:2 to 4:1) varies the etch rate and is modified to suit the aluminum surface composition.

Without rinsing, the wafer is transferred to the second step which is a nickel immersion treatment. Nickel ions exchange with fluoride ions on the aluminum surface and activate in a nondeleterious manner. The nickel complex is chosen by the amount of nickel ions one wants to produce. The chloride complex accelerates conversion to nickel ions while the acetate complex retards conversion relative to the sulfate complex. The other major component produces a common ion effect and provides an ion to exchange with fluoride ions on the mask surface. For example, chloride ions in ammonium chloride exchange with fluoride ions on the mask surface to deactivate it relative to the aluminum. This confines nickel deposition to the desired area. The citrate and acetate complexes deactivate more slowly than the ammonium chloride complex. p-Toluene sulfonic acid, p-TOS, wets the surface but is an optional component of the bath. A small amount of BOE is also included to prevent the formation of aluminum hydrous oxide.

Without rinsing, the wafer is transferred from the nickel immersion treatment to the electroless plating bath. At this point, there are fluoride and nickel ions on the surface which can readily be replaced with nickel metal. The deposition of the nickel metal is self-propagating. A typical bath composition with suitable concentration and reaction condition ranges is as follows:

| PLATING BATH | | |
|---|---|---|
| | Per 1.5 liter $H_2O$ | |
| Nickel sulfate | 15–45 g | 0.05–0.2 M |
| Sodium acetate | 5–85 g | 0.05–0.5 M |
| Sodium hypophosphite | 2.5–25 g | 0.02–0.2 M |
| BOE | trace - 10 ml. | |
| p-TOS | trace - 0.15 g | |
| Formaldehyde | trace - 50 ml | |

-continued

| PLATING BATH | |
|---|---|
| Ethanol | trace - 150 ml. |
| Boric acid | trace - 65 g |
| 25° C.–95° C. | |
| slight agitation | |
| pH 3.5–7 | |
| rate - 0.1μm–5μm/8 min. | |

Concentration of the bath compounds is adjusted to accommodate various types of aluminum surfaces and to control deposit characteristics. Other reducible nickel salts, hypophosphites, or organic acid salt complexing agents may be used. The various buffers, stabilizers, and wetting agents affect deposit characteristics and bath controllability. The concentration of BOE requires control for quality deposits. A low molecular weight alcohol, such as methanol or ethanol, and p-TOS wet the substrate surface and reduce surface tension at the mask to aluminum interface. As an acid, p-TOS may also prevent formation of hydrous oxide on the substrate surface. Formaldehyde is a stabilizer. Boric acid stabilizes, buffers, and acts as a leveler to control particle size.

Time and temperature regulate the rate of deposit. Typically, one micrometer of nickel will be deposited in about 8 minutes at 72° C. To obtain thicker deposits, samples may be plated for longer time or the boric acid and BOE concentration can be reduced and/or sodium hypophosphite concentration can be increased. The nickel deposit contains 2–4% phosphorus which advantageously hardens the metal. Bath temperature can range from 25° C. to 95° C. with maximum efficiency at approximately 72° C. High temperatures cause the bath to decompose more quickly and low temperatures excessively slow the rate and may allow the acid in the bath to etch into the aluminum. The pH can range between about 3.5 and 7 with maximum efficiency at approximately 6.8. At pH 7, deposition is slow and particle size decreases. At pH 3.5, deposition is also slow and acid can attack the aluminum.

Subsequent to deposition, the substrate is rinsed with water, blotted to remove the excess, and allowed to air dry. It may be desirable to anneal the substrate in a reducing atmosphere such as forming gas (20% hydrogen and 80% nitrogen) at 200° C. to 425° C. Annealing assures bonding between aluminum and nickel.

In semiconductor processing, nickel pads may be directly soldered or with subsequent gold plating may be ball bonded, applique bonded, or subjected to other known procedures for providing leads or bonding to lead frames. As bonding pads, the thick nickel deposits spread laterally around the edges of the masked area and hermetically seal the contact area. This process also seals pinhole defects in the mask with nickel.

It may be desirable to plate the nickel deposit with gold or copper before further processing. A rinse with a mixture of BOE and ethylene glycol or some other nonaqueous solvent is recommended before electroless deposition of gold by the technique disclosed in Example II below or by a commercially available technique.

The following examples are given by way of illustration only and are not to be construed as limitations of the many variations possible within the scope of the invention.

EXAMPLE I

Figure 2:
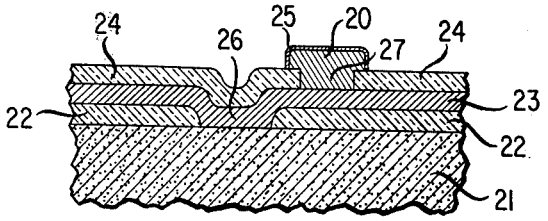
FIG. 2 illustrates a nickel bonding pad as deposited on an aluminum metallized integrated circuit wafer by the method of FIG. 1. It further includes a gold layer deposited by the disclosed electroless gold plating technique.

This example describes the formation of nickel bonding pads 20 on an aluminum metallized integrated circuit wafer to produce the structure illustrated in FIG. 2.

A silicon substrate 21 with a silicon dioxide passivating layer 22 was used. Aluminum layer 23 was thermally evaporated onto substrate 21. Apertures 26 were defined in silicon dioxide 22 to permit aluminum layer 23 to contact silicon substrate 21. A circuit pattern was defined on aluminum layer 23 by standard photolithographic techniques. Silicon nitride layer 24 was then deposited on aluminum layer 23. Standard photolithographic techniques were used to define apertures 27 in silicon nitride layer 24.

The wafer, having a top surface comprising silicon nitride layer 24 and aluminum layer 23, was processed according to FIG. 1. That is, the wafer was cleaned by rinsing in deionized water; scrubbing with Triton X 100 (trademark of Rohm and Haas); rinsing again in deionized water; and rinsing in ethylene glycol.

The wafer was then subjected to the following pretreatment:

| Pretreatment | |
|---|---|
| STOP-ETCHANT | |
| (1:1) BOE:ethylene glycol | |
| Room Temperature, 18° C. | |
| 75 sec | |
| NICKEL IMMERSION | |
| | Per liter $H_2O$ |
| Nickel sulfate | 66 g |
| Ammonium chloride | 0.18 g |
| (10:1) $H_2O$:BOE | 6 ml |
| Room temperture, 18° C. | |
| 35 sec | |

The wafer was transferred to an electroless plating vat containing the following solution:

| PLATING BATH | |
|---|---|
| | Per liter $H_2O$ |
| Nickel sulfate | 27 g |
| Sodium acetate | 9 g |
| Sodium hypophosphite | 4.5 g |
| Boric acid | 9 g |
| p-TOS | 0.09 g |
| (10:1) $H_2O$:BOE | 4.8 ml. |
| Formaldehyde | 0.6 ml. |
| Methanol | 6 ml. |
| 71.5° C. | |
| pH 6.8 | |
| 60 min. | |
| slight agitation | |

After removal from the plating bath, the wafer was rinsed with deionized water until the water resistivity returned to its original value. The wafer was air dried and the following properties were measured:

| | |
|---|---|
| Height of Nickel bonding pad 20 | 15.7 μm |
| Resistivity | 100–200 μohm-cm |
| Tensile Strength | $1 \times 10^{10}$ dyne/cm$^2$ |
| Contact Resistance | <0.01 ohms |
| Deposit Hardness | 350 $H_v$ (Vicker Hardness) |

EXAMPLE II

This example discloses a technique for electroless deposition of a gold layer 25 on the nickel bonding pads 20 fabricated according to Example I and illustrated in FIG. 2.

Nickel pad 20 was scrubbed with Triton X 100 and rinsed in deionized water. The sample was rinsed with (1:1) BOE:BG and immediately transferred to the plating bath.

A plating bath comprising of the following components was used to deposit gold layer 25 on nickel pad 20. Suitable concentration ranges are given.

| PLATING BATH | | |
|---|---|---|
| | Grams/Liter $H_2O$ | Moles/Liter |
| Potassium gold cyanide | 0.5–10 | 0.0015–0.03 |
| Potassium cyanide | 0.1–6 | 0.0015–0.09 |
| Sodium hypophosphite | 1–20 | 0.009–0.19 |
| Sodium acetate | 1–30 | 0.01–0.37 |
| Sodium bicarbonate | 0.2–10 | 0.02–0.12 |
| 18° C.–98° C. | | |
| pH 4.5–9 | | |
| rate ~ 0.1–0.5 μm/15 min. | | |

The sample was rinsed with deionized water and after annealing the following properties were measured:

| | |
|---|---|
| Height of Ni-Au Deposit (layers 20 and 25) | 15.2–15.5 μm |
| Resistivity | 80–150 μohm-cm |
| Deposit Hardness | 180 $H_v$ |
| Accelerated Aging | <1% Pad Failure |
| (85° C., 85 percent relative humidity, 2000 hrs.) | |

Wire ball bonds were fabricated by well known techniques using a thermocompression ball bonder. The strength of 1 mil gold wire was found to be between 10–15 g/wire.

The above-described technique for electroless deposition of gold is applicable to plating on most metals such as nickel, aluminum, copper, etc. The sample is pretreated with a mixture of BOE and a non-aqueous solvent to remove oxides on the surface. The bath components are illustrative. Other soluble gold cyanide complexes, cyanide salts, hypophosphites, etc. would be acceptable. The sodium acetate and sodium bicarbonate buffer the bath. For nickel, optimum results have been obtained at approximately pH 7. The technique is autocatalytic and, thus, produces thick deposits.

EXAMPLE III

Figure 3:
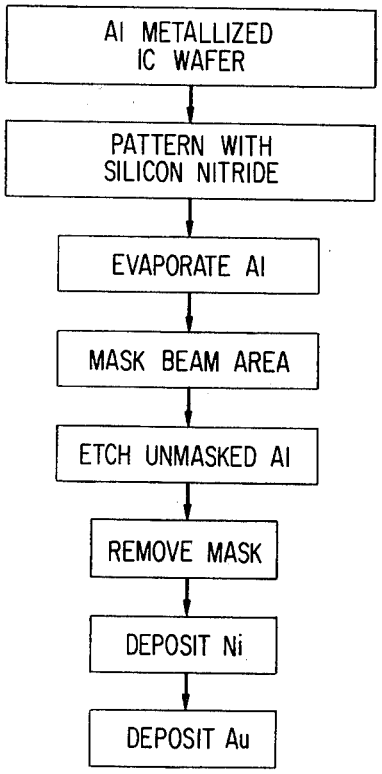
FIG. 3 is a flow diagram indicating the method steps for beam leading an integrated circuit wafer with the inventive method.

This example illustrates a technique for forming beam leads by the inventive method. Beam leads are electroformed electrodes, frequently cantilevered beyond the wafer edges. FIG. 3 is a flow diagram of the process steps involved in creating the device shown in FIG. 4D.

Figure 4A:
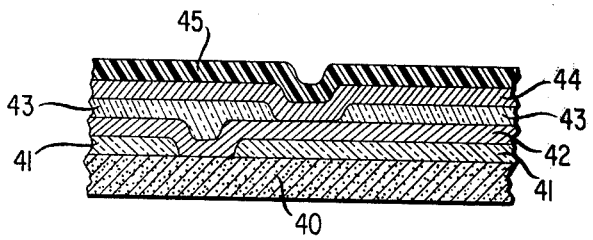
FIGS. 4A–D are cross-sectional views of a beam leaded device at sequential stages during the processing described by FIG. 3.
Figure 4B:
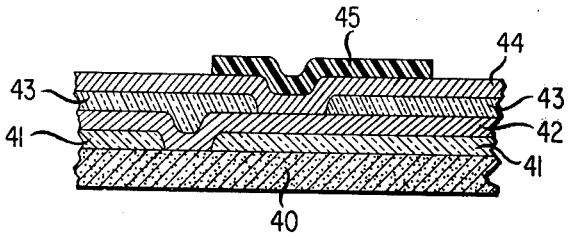
Figure 4C:
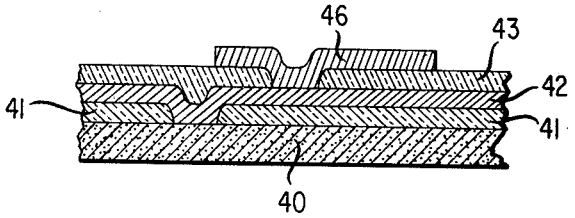
Figure 4D:
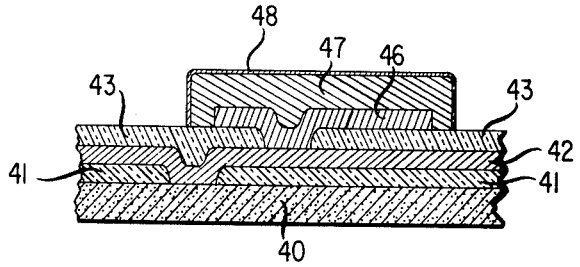

A standard integrated circuit wafer as shown in FIG. 4A comprising silicon substrate 40, silicon dioxide passivating layer 41, and aluminum contact metallization 42 is the starting point. Aluminum metallization 42 is patterned with silicon nitride 43 to define contact areas. Another aluminum layer 44 is thermally evaporated onto the silicon nitride patterned aluminum. Photoresist 45 is applied to layer 44. Standard photolithographic techniques are used to mask the beam area as shown in FIG. 4B. The unmasked aluminum on layer 44 is etched away. Photoresist 45 is removed. FIG. 4C illustrates the resulting aluminum beam 46. Now, the electroless nickel deposition technique described in Example I is used to plate a thick nickel beam 47 over aluminum beam 46. FIG. 4D illustrates the beam lead. The electroless gold deposition technique described in Example II is used to plate gold layer 48 on nickel beam 47.

It is to be understood that the above-described examples are merely illustrative of the many possible specific embodiments which can be devised to represent application of the principles of this invention. Numerous and varied arrangements can be devised with these principles by those skilled in the art without departing from the spirit and scope of the invention.

What is claimed is:

1. A method of chemically depositing gold on a metal surface comprising the steps of:

(a) cleaning said surface in a solution of buffered hydrofluoric acid and a nonaqueous solvent;

(b) subjecting said surface to a bath comprising an aqueous solution of a soluble gold cyanide complex, a soluble cyanide salt, hypophosphite reducing agent, and an admixture of sodium bicarbonate and sodium acetate buffering agents;

said bath being maintained at a pH of about 4.5 to 9 and a temperature of about 18° C. to 98° C.

2. The method of claim 1 wherein said bath consists essentially of an aqueous solution of the following:

| | Grams/Liter $H_2O$ | Moles/Liter |
|---|---|---|
| potassium gold cyanide | 0.5–10 | 0.0015–.03 |
| potassium cyanide | 0.1–6 | 0.0015–0.09 |
| sodium hypophosphite | 0.2–10 | 0.009–0.19 |
| sodium acetate | 1–30 | 0.01–0.37 |
| sodium bicarbonate | 1–20 | 0.02–0.12 |

said bath being maintained at a pH of about 4.5 to 9 and at a temperature in the range of about 18° C. to 98° C.

3. The method of claim 2 wherein said metal surface is nickel.

4. The method of claim 2 where said pH is maintained at approximately 7 and said temperature is approximately 95° C.

5. The method of claim 1 wherein said bath comprises:

(a) an aqueous solution of a soluble gold cyanide complex, from about 0.0015 to 0.03 mole per liter;

(b) a cyanide salt, from about 0.0015 to 0.09 mole per liter;

(c) a hypophosphite reducing agent, from about 0.009 to 0.19 mole per liter;

(d) sodium bicarbonate buffering agent, from about 0.02 to 0.12 mole and sodium acetate buffering agent, from about 0.01 to 0.37 moles.

* * * * *

UNITED STATES PATENT AND TRADEMARK OFFICE

CERTIFICATE OF CORRECTION

PATENT NO. : 4,154,877

DATED : May 15, 1979

INVENTOR(S) : Frederick Vratny

It is certified that error appears in the above-identified patent and that said Letters Patent are hereby corrected as shown below:

Column 3, line 65, "5-85g" should read --5-65g--, "0.05-0.5M" should read --0.04-0.5M--. Column 4, line 9, "-0.1" should read --∿0.1--. Column 6, line 11, after comprising delete "of".

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*